United States Patent [19]

Brimo

[11] 4,145,027

[45] Mar. 20, 1979

[54] SAFETY DEVICE

[76] Inventor: Joseph Brimo, 1523 N.Hills Ave., Willow Grove, Pa. 19090

[21] Appl. No.: 854,631

[22] Filed: Nov. 25, 1977

Related U.S. Application Data

[63] Continuation of Ser. No. 734,538, Oct. 21, 1976, abandoned.

[51] Int. Cl.[2] ..... A62B 1/08; B66D 5/00

[52] U.S. Cl. ..... 254/156; 182/3

[58] Field of Search ..... 254/151, 154, 155, 156, 254/157; 188/64; 182/3, 4, 5, 6, 7

[56] References Cited

U.S. PATENT DOCUMENTS

| | | | |
|---|---|---|---|
| 202,767 | 4/1878 | Swank et al. | 254/154 |
| 304,603 | 9/1884 | Blott | 254/154 |
| 456,532 | 7/1891 | Bliss | 188/64 |
| 554,587 | 2/1896 | Evans | 254/154 |
| 612,673 | 10/1898 | Reidy et al. | 254/154 |
| 1,144,702 | 6/1915 | Forest | 254/154 |
| 1,241,701 | 10/1917 | Bencur | 254/156 |
| 3,915,432 | 10/1975 | Bustamante | 254/157 |

*Primary Examiner*—Francis S. Husar
*Assistant Examiner*—D. W. Underwood
*Attorney, Agent, or Firm*—Weiser, Stapler & Spivak

[57] ABSTRACT

A safety device suitable for escaping a building through a window thereof which includes a slide capable of lowering a building occupant along a cable in a controlled descent path. The slide comprises a plurality of pulleys through which the cable slidingly passes in a serpentine path. One of the pulleys includes a brake which is capable of closely controlling the rate of travel of the cable about the pulley. External controls permit the user to closely regulate the speed of descent by varying the braking pressure applied at the brake pulley.

2 Claims, 4 Drawing Figures

SAFETY DEVICE

This is a continuation of application Ser. No. 734,538, filed Oct. 21, 1976, and now abandoned.

BACKGROUND OF THE DISCLOSURE

The present invention relates generally to the field of safety devices, and more particularly, is directed to a device which slides relative to a building affixed cable to permit a building occupant to descend thereon.

All multi-story buildings are provided with stairs or other means to both gain access to the upper floors and to permit the occupants to leave the upper floors when it is so desired. In the case of commercial and industrial structures of multi-story construction, it is the common practice to employ both elevators and stairs to permit workers and business visitors to reach the upper foors. Due to the dangers inherent in buildings of multi-story construction, building codes and fire codes have been developed by governmental, insurance and safety officials to regulate construction and to design safe means of egress from such buildings. The building and safety codes generally require the construction of suitable fire stairs, fire towers or similar types of fire-resistant means of egress. However, despite the previous attempts to render buildings safe for egress in times of emergency, fire reports abound with statistics of persons injured or killed when trapped within buildings wherein they are unable to reach the stairs or fire towers installed within the building. In smaller buildings, such as small apartment buildings, prior workers in the art have developed emergency means of egress such as fire ropes, fire ladders, folding ladders and other types of portable escape means which could permit a building occupant to escape through a window to thereby reach the ground without the need to use the building stairways. Other workers have attempted to solve the problem of emergency egress from larger buildings by providing cables which position exteriorly of the building and which have reels or slides for descent purposes. The devices disclosed in U.S. Pat. Nos. 2,561,832, 2,526,065, 3,926,298, 2,499,853, 2,452,324, 1,229,394, 1,098,223, 688,592, 544,587, 272,129 and 282,892 are exemplary of this type of escape mechanism. The prior art cable and reel types of constructions have proved cumbersome in construction and quite difficult in operation when attempting to regulate the rate of descent relative to the cable.

SUMMARY OF THE INVENTION

The present invention relates generally to the field of emergency escape systems, and more particularly, is directed to a combination slide mechanism which functions along a building-connected cable to permit a building occupant to lower himself to the ground at a controlled rate of speed.

The present invention comprises a slide which moves relative to a cable which is attached to portions of a building in the vicinity of a window. The slide comprises a plurality of rotating pulleys about which the cable is trained to form a serpentine interior path through the slide. One of the pulleys is equipped with a hand-operated brake to closely regulate the rotative speed of the pulley as the slide descends along the cable.

The brake pulley includes an operating handle which extends outwardly from the slide to facilitate easy manual adjustment of the frictional engagement of the brake upon the pulley by the user. By turning the handle in either a clockwise or counter-clockwise adjustment, the braking pressure of the brake upon the brake pulley can be easily adjusted by the user to either speed up or slow down the rate of descent of the slide along the cable. The device is simple in construction and easy to use and provides a portable, inexpensive slide device capable of lowering a building occupant to the ground without injury during times of emergency.

It is therefore an object of the present invention to provide an improved building escape safety device of the type set forth.

It is another object of the present invention to provide a novel safety device which includes a slide capable of descending along a cable and a manually controlled brake pulley to easily adjust the rate of descent of the slide.

It is another object of the present invention to provide a novel safety device incorporating a slide, a plurality of pulleys rotatively carried by the slide, the pulleys being arranged to form a serpentine path of travel of a cable within the slide for descent control purposes.

It is another object of the present invention to provide a novel safety device incorporating a cable and a slide movable along the cable, the slide including a brake unit pulley and control handle means to vary the pressure applied by the brake to control the rotative speed of the brake pulley.

It is another object of the present invention to provide a novel safety device comprising a cable and slide movable relative to the cable, the slide incorporating descent speed control means and handle means projecting exteriorly from the slide to facilitate functioning of the speed control means by the user.

It is another object of the present invention to provide a novel safety device incorporating a slide and a frame exteriorly affixed to the slide, said frame including grasping means to facilitate gripping of the device by the user.

It is another object of the present invention to provide a novel safety device that is rugged in construction, inexpensive in manufacture and trouble-free when in use.

Other objects and a fuller understanding of the invention will be had by referring to the following description and claims of a preferred embodiment thereof, taken in conjunction with the accompanying drawings, wherein like references characters refer to similar parts throughout the several views and in which:

DESCRIPTION OF THE PREFERRED EMBODIMENT OF THE INVENTION

Figure 1:
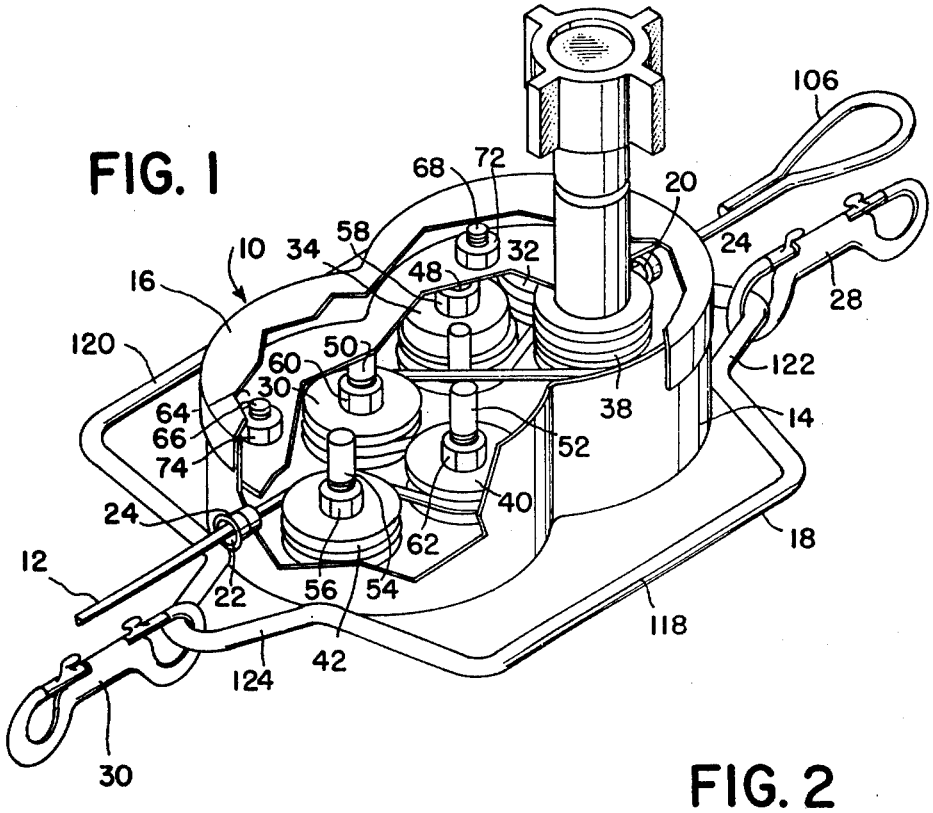
FIG. 1 is an isometric view of a safety device in accordance with the present invention, partially broken away to expose interior construction details.

Although specific terms are used in the following description for the sake of clarity, these terms are intended to refer only to the particular structure of the invention selected for illustration in the drawings and are not intended to define or limit the scope of the invention.

Figure 2:
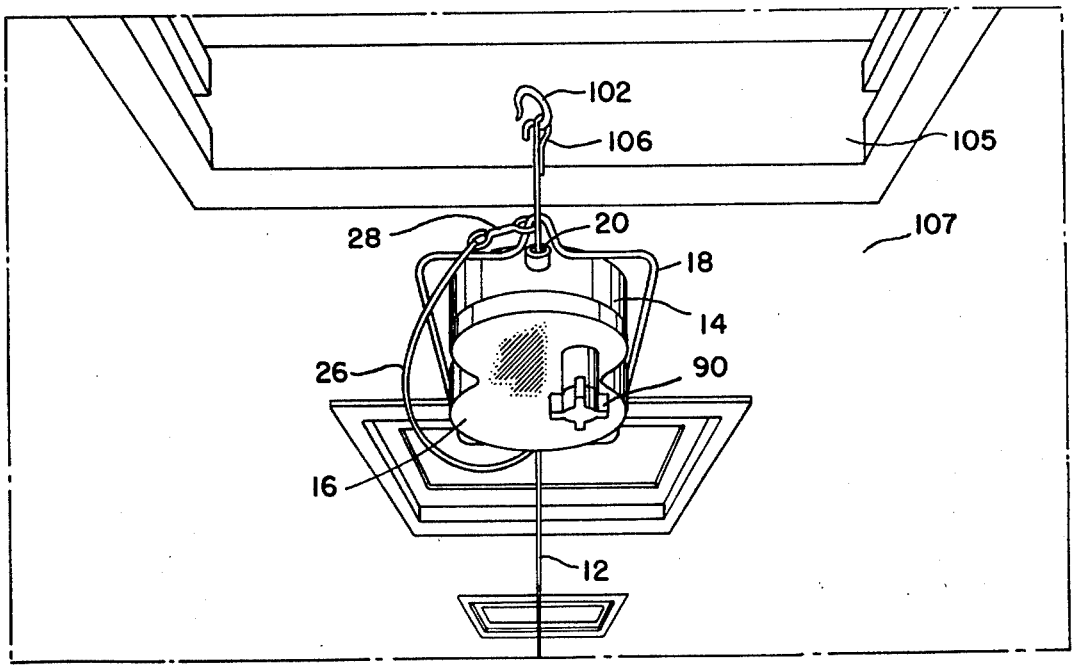
FIG. 2 is a perspective view showing the safety device in use attached to a building.

Referring now to the drawings, there is shown the safety device 10 of the invention associated with a flexible steel cable 12. The safety device 10 comprises generally a hollow body 14 within which are enclosed a plurality of pulleys in the manner hereinafter more fully set forth. The pulleys are enclosed within the body 14 and covered to prevent contact by a suitable cover 16. It will be noted that the cable passes through a top opening 20, travels around and about the pulleys and thence outwardly through the bottom opening 22 in a manner to permit the safety device 10 to slide relatively to the cable 12 when in use. The openings 20, 22 may be protected with hardened steel or other hardened material inserts 24 if so desired to facilitate movement of the cable through the openings 20, 22 without damage to the cable. A peripheral frame 18 is welded or otherwise secured to the body 14 in sturdy manner. As illustrated, portions of the frame 18 are spaced from the body 14 to permit easy grasping of the frame by the user. As best seen in FIG. 2, a strap 26 including upper and lower snap fasteners 28, 30 is employed to securely lock the user to the safety device 10 when in use.

Figure 4:
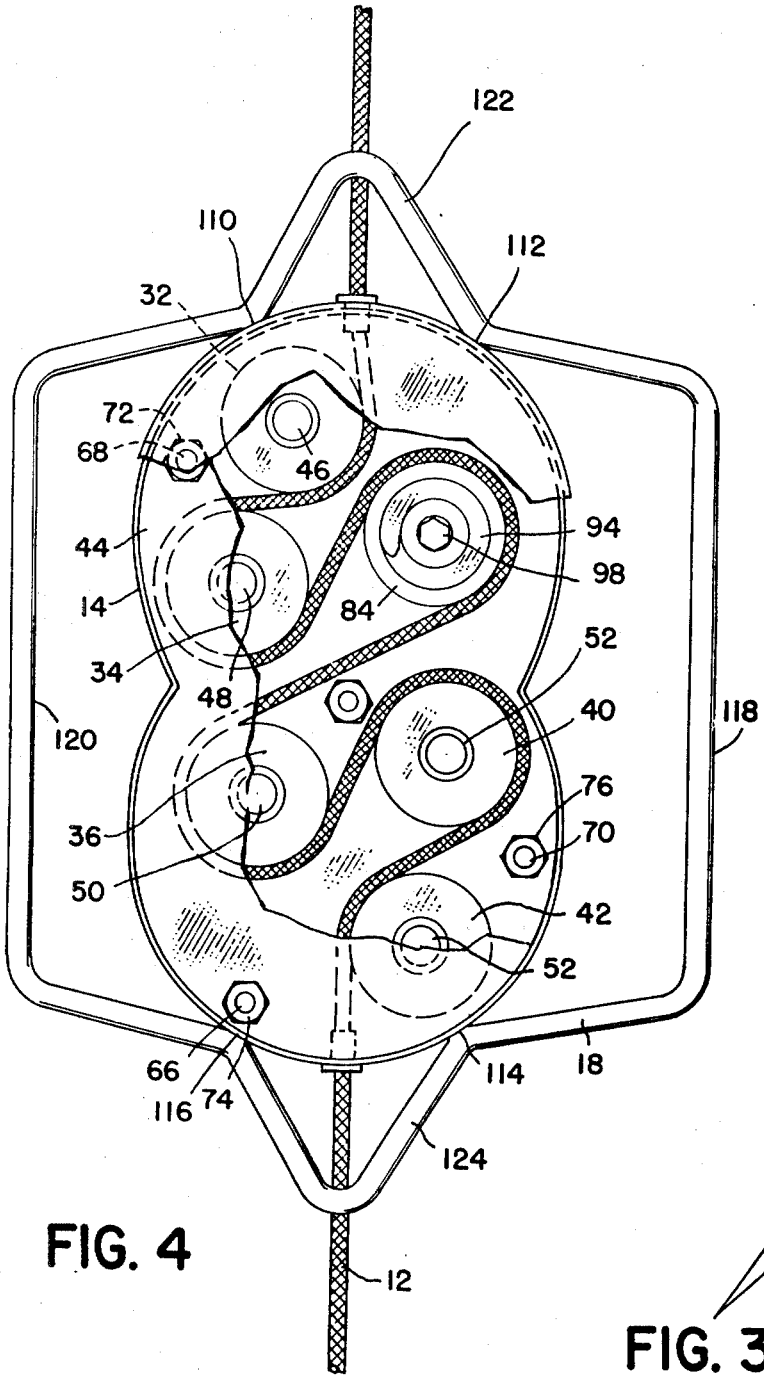
FIG. 4 is a side elevational view of the slide, partially broken away to expose interior construction details.

Referring now to FIGS. 1 and 4, it will be seen that a plurality of cable pulleys 32, 34, 36, 40 and 42 are rotatively carried within the body 14. A plurality of pulley shafts 46, 48, 50, 52, 54 are secured to and extend outwardly from the body floor 44 in sturdy manner to permit rotation of the pulleys 32, 34, 36, 40 and 42 about their respective shafts when the device is in use. A brake pulley is rotative about the threaded studs 78 as hereinafter more fully set forth. The cable pulleys 32, 34, 36, 40, 42 and brake pulley 38 are positioned within the interior of the body 14 in a manner to form a serpentine path for the cable 12 within the interior of the body 14 to provide better control as the body 14 slides relatively to the cable 12 when the device is in use. Suitable lock nuts 56, 58, 60, 62 are employed to secure each cable pulley upon a respective shaft, 32, 46; 34, 48; 36, 50; 40, 52 and 42, 54 in rotative engagement in conventional manner.

An interior plate 64 overfits the tope of the respective pulley shafts 46, 48, 50, 52, 54 within the body 14 to provide a sturdy construction. Conventional studs 56, 68, 70 project upwardly from the floor 44 of the body 14 and pass through apertures provided in the interior cover 64. Suitable nuts 72, 74, 76 secure the construction to lock the various pulleys 32, 34, 36, 38, 40, 42 within the body 14.

Figure 3:
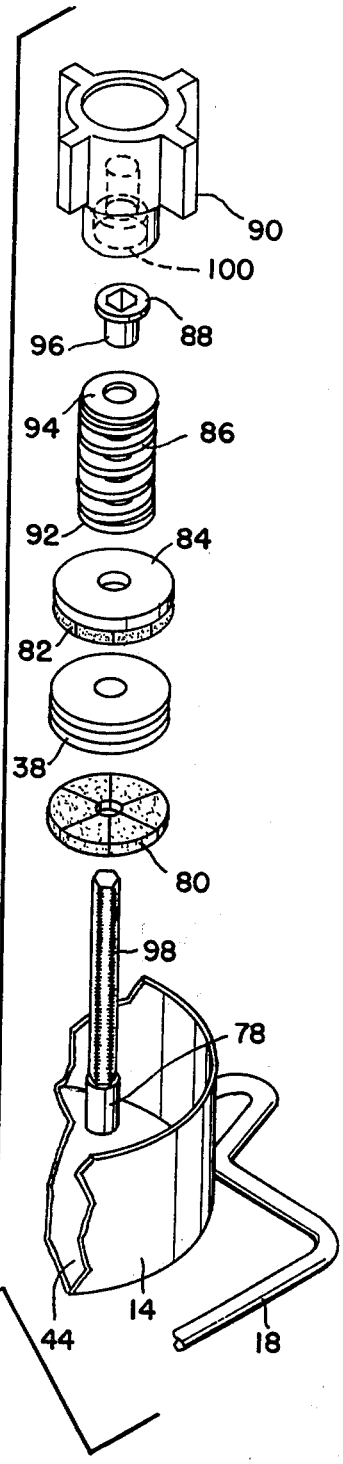
FIG. 3 is an enlarged, exploded, isometric view of the brake mechanism.

As best illustrated in FIG. 3, the cable pulley 38 serves as a brake pulley and is rotatively positioned on the threaded stud 78. A brake washer 80 which is fabricated of conventional brake lining material overfits the stud 38 and rests against the body floor 44. The cable pulley 78 rotatively mounts on the stud 78 and overlies the brake washer 80. A second brake washer 82 overlies the brake pulley 38 in a manner to sandwich the brake pulley 38 between the brake washers 80, 82.

A hard washer 84 overfits the stud 78 and may be cemented or otherwise secured to the brake washer 82 if so desired. The hard washer 84 serves to distribute axial forces applied through the coil spring 86 when the device is in use. As illustrated, the spring 86 overfits the threaded stud 78 and has its inner end 92 in contact with the hard washer 84. A threaded nut 96 threadedly engages the threaded section 98 of the stud 78 in conventional manner. The nut 96 includes a radially extending shoulder 88, which shoulder presses against and engages the outer end 94 of the spring 86.

The handle 90 includes a bottom positioned socket 100 into which the outer end 94 of the spring 86 seats. The shouldered nut 96 secures the spring 86 to the handle 90 in a secure, threaded engagement upon the threaded end 98 of the stud 78. Thus, by turning the handle 90 about the threaded end 98 of the stud 78, the nut 96 will turn on the threaded end 98 to compress the spring 86. As the spring 86 is compressed by rotation of the handle 90, the bias of the spring 86 acts to urge the respective brake lining washers 80, 82 into tighter frictional contact with the sides of the brake pulley 38. Frictional engagement of the brake lining washers 80, 82 can thus be readily varied by rotation of the handle 90 in either a clockwise or counterclockwise direction upon the threaded end 98 of the stud 78 to either tighten or loosen the rotative engagement of the brake pulley 38.

As best seen in FIGS. 1 and 4, the cable 14 is trained about the brake pulley 38 and accordingly, the slippage of the safety device 10 relative to the steel cable 12 can thus be regulated closely by controlling the relative freedom of the brake pulley 38.

In order to use the device, a hook 102 or other stationary member is affixed to a building construction 107 at a building opening such as a window 105. One end 106 of the cable 12 is securely affixed to the hook 102 and the remainder of the cable 12 extends downwardly to the ground as best seen in FIG. 2. The slide is positioned exteriorly of the building 102 opposite the window 105 and the operating handle 90 is rotated to securely lock the slide 10 in this position on the cable 12. The user (not illustrated) then unsnaps either of the snap fasteners 28 or 30 from its associated frame strap connection section 122, 124 and secure the safety strap 26 about him, such as by employing a safety harness or belt (not shown) or by encircling his body, for example, about the chest with the safety strap 26. Once the body of the user is secured to the strap 26, the fastener 28 or 30 is again secured to the safety device frame 18.

After the strap 26 is secured in position, the user can exit through the window 105 and allow his weight to be fully supported exteriorly of the building 107 by the safety device 10 as it is locked upon the cable 12. The handle 90 is then turned slowly to decrease the frictional forces applied against the faces of the brake pulley 38 by the brake lining washers 80, 82. When the forces of gravity resulting from the weight of the user are sufficient to overcome the frictional forces generated by the brake lining washers 80, 82 against the brake pulley 38, the safety device 10, with the user, will descend along the cable 12 as the cable passes about the interior pulley systems 32, 34, 36, 40, 42 and the brake pulley 38. The rate of descent of the safety slide 10 relative to the cable 12 can be controlled either faster or slower by the user by turning the handle 90 in either a clockwise or counterclockwise direction. It will be noted that the frame 18 is welded or otherwise secured to the body 14 in a plurality of spaced locations 110, 112, 114, 116. The frame 18 extends outwardly from the body 14 intermediate the welded connections to define transversely spaced grasping sections 118, 120 and vertically spaced strap connection sections 122, 124. Thus, the user can securely graps the frame 18 at the grapsing sections 118, 120 during the descent, if so desired.

Although the present invention has been described with reference to the particular embodiments herein set forth, it is understood that the present disclosure has been made only by way of example and that numerous changes in the details of construction may be resorted to without departing from the spirit and scope of the invention. Thus, the scope of the invention should not be limited to the foregoing specification, but rather only by the scope of the claims appended hereto.

What is claimed is:

1. In a safety device suitable for lowering a building occupant along a cable having a portion thereof affixed to the building, the combination of a body having a cable passing therethrough, said body having a longitudinal axis and a transverse axis;

a plurality of cable pulleys rotatively carried by the body, some of said pulleys being positioned to the right of the longitudinal axis and some being positioned to the left of the longitudinal axis, at least some of said pulleys being permanently spaced an unequal distance from the said longitudinal axis, said cable being trained about the pulleys to form a serpentine path within the body; and a brake pulley means rotatively carried by the body, said brake pulley means comprising a brake pulley, having a flat circular surface, a first brake lining applied directly to the circular flat surface of the brake pulley to retard the rotation thereof and a handle means to vary the pressure of the brake lining against the brake pulley, said brake pulley means further comprising a threaded stud secured to the body, the handle being threadedly engaged upon the stud to vary brake pressure, the brake pulley being rotatively mounted on the stud and comprising a peripheral groove into which the cable is positioned to rotate the brake pulley as the cable passes through the body, the peripheral groove being of size to receive a single turn of the cable, the cable on the brake pulley always being positioned the same distance from the threaded stud under all conditions of use, some of said pulleys being positioned on the inlet side of the transverse axis and wherein all of said pulleys are spaced an unequal distance from said transverse axis and wherein said brake pulley is so positioned relative to said cable pulleys that the cable is always seated within more than one half the circumferential length and less than the entire circumferential length of the brake pulley groove.

2. The safety device of claim 1 wherein grasping means secured to the body are provided for grasping by the occupant as he uses the safety device for covering himself from a building, the grapsing means extending peripherally about the body.

* * * * *